US006145716A

United States Patent [19]

Caicedo

[11] Patent Number: 6,145,716

[45] Date of Patent: Nov. 14, 2000

[54] COMBINATION BACKPACK AND FOLDING CHAIR

[76] Inventor: Gustavo Caicedo, 26641 La Sierra Dr., Mission Viejo, Calif. 92691

[21] Appl. No.: 09/420,245

[22] Filed: Oct. 19, 1999

[51] Int. Cl.[7] ..... A45F 4/02

[52] U.S. Cl. ..... 224/155; 297/129; 297/59

[58] Field of Search ..... 224/153, 155, 224/156, 627; 297/129, 31, 59

[56] References Cited

U.S. PATENT DOCUMENTS

| | | | |
|---|---|---|---|
| 4,286,739 | 9/1981 | Silcott et al. | 224/155 X |
| 4,577,901 | 3/1986 | Phillips | 224/155 X |
| 4,676,548 | 6/1987 | Bradbury | 224/155 X |
| 4,720,029 | 1/1988 | Varanakis | 224/155 |
| 5,139,308 | 8/1992 | Ziman | 224/155 X |
| 5,533,654 | 7/1996 | Holty et al. | 224/155 |

FOREIGN PATENT DOCUMENTS

| | | | |
|---|---|---|---|
| 9318688 | 9/1993 | WIPO | 224/155 |

*Primary Examiner*—Gregory M. Vidovich
*Attorney, Agent, or Firm*—Roy A. Ekstrand

[57] ABSTRACT

A generally U-shaped seat frame defines a crossmember and side portions terminating in a pair of ends. A seatback frame provides a second generally U-shaped member having a second crossmember and side portions which terminate in a pair of acutely angled support members. The ends of the seat frame are pivotally secured to the support members of the seatback frame. A fabric seat web is secured to the side portions of the seat frame while a backpack is secured to the seatback frame. The seat frame is pivotable with respect to the seatback frame between an open position forming a chair and a closed position in which the seatback frame and seat frame are locked together on the rear portions of the backpack.

7 Claims, 3 Drawing Sheets

10
11
12
13
15
20
22
24
27
30
31
32
35
36
40
41
44
50
51
52
54
55
59
70
71
72

COMBINATION BACKPACK AND FOLDING CHAIR

FIELD OF THE INVENTION

This invention relates generally to folding chairs and particularly to those intended to be portable for carrying and travel.

BACKGROUND OF THE INVENTION

Folding chairs are well known in the art and have been fabricated of various materials and have been the subject of a variety of designs through the years. The convenience, portability and space-saving advantages of folding chairs have prompted practitioners in the art to design, create and fabricate a wide variety of folding chairs. Perhaps the most common and pervasive folding chair is found in a design-type generally referred to as "card table chairs" this type of folding chair gets its name from its frequent association and combination with a folding card table. A typical folding card chair utilizes a frame formed of a rigid material such as metal or the like having a pair of frame members joined at an intermediate pivot to form a "scissors-like" folding unit. The folding action involves simply pivoting the scissors-like frame members between a parallel configuration and an unfolded configuration in which the frame members define a configuration generally resembling the letter X. Folding chairs have not been limited however, to use with card tables but have included relatively formal highly stylized or decorative chairs using ornate folding frames and softly padded or upholstered seating and back rest surfaces. Still other folding chairs have included light-weight portable beach or picnic chairs intended for use outdoors. Such folding chairs are typically formed of a light-weight material such as aluminum tubing or the like and frequently employ seat and back rest surfaces formed of a canvas-like material stretched between frame support members. Similar folding chair devices have been fabricated for use in combination with other camping equipment. The object of such camping-like type folding chairs is usually the provision of a very light-weight minimal seat structure which can be carried in a convenient portable pack or the like.

While the foregoing prior art devices have to some extent improved their respective areas of the art and have in some instances enjoyed commercial success, there remains nonetheless a continuing need in the art for ever more improved, effective and efficient folding chair apparatus.

SUMMARY OF THE INVENTION

Accordingly, it is a general object of the present invention to provide an improved folding chair. It is a more particular object of the present invention to provide an improved folding chair suitable for combination with a backpack device. It is a still more particular object of the present invention to provide an improved folding chair in combination with a backpack device which maximizes the strength and stability of the chair while minimizing the folded size configuration thereof.

In accordance with the present invention there is provided a combination backpack and folding chair comprising: a backpack having a front surface and a rear surface; a seat frame having a first crossmember and a first pair of ends; a seatback frame having a second crossmember, a pair of sides, a pair of support members and a second pair of ends, the pair of support members forming acute angles with the sides; a pair of pivots pivotally securing the first pair of ends to the pair of support members; a seat web secured to the seat frame; and means for attaching the backpack to the seatback frame, the seat frame being pivotable with respect to the seatback frame between an open configuration forming a chair and a closed configuration in which the seat web overlies the rear surface.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
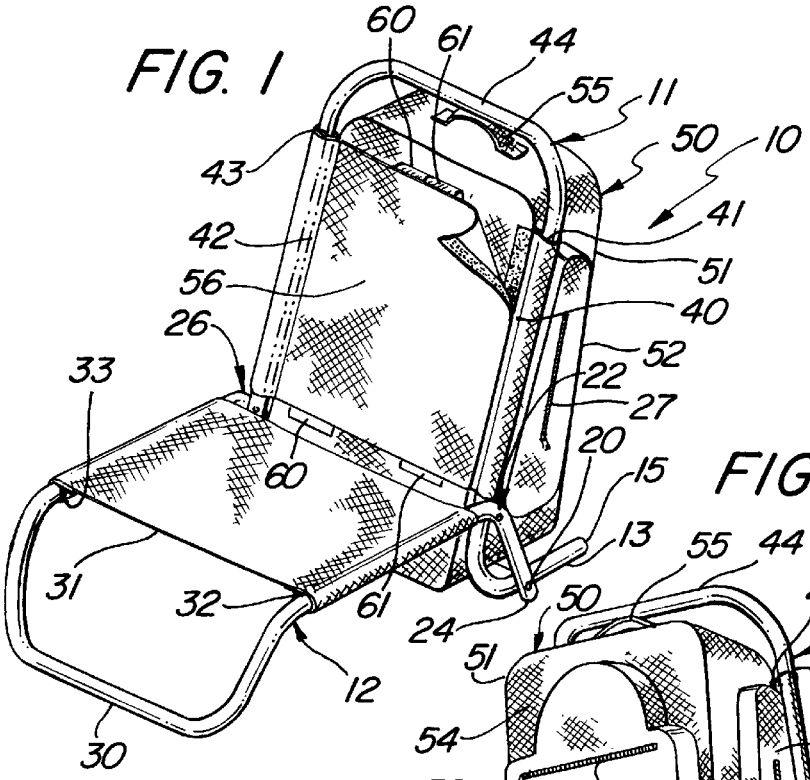
FIG. 1 sets forth a front perspective view of a combination backpack and folding chair constructed in accordance with the present invention in its open configuration.

FIG. 1 sets forth a front perspective view of a combination backpack and folding chair constructed in accordance with the present invention and generally referenced by numeral 10. Combination device 10 includes a generally U-shaped seatback frame 11 preferably formed of a light-weight rigid material such as hollow aluminum tubing or the like together with a generally U-shaped seat frame 12 also preferably formed of a rigid light-weight material such as aluminum material or the like. Seatback frame 11 includes a crossmember 44 extending across the upper portion thereof and extends downwardly from each side of crossmember 44 forming a pair of horizontal support portions 13 and 14 (support portion 14 shown in FIG. 2) support portion 13 defines and end 15 while support portion 14 defines and end 16 (seen in FIG. 2). As is better seen in FIG. 2, support portions 13 and 14 are joined by a crossmember 28 extending therebetween.

Seat frame 12 includes a crossmember 30. Seat frame 12 extends on each side of crossmember 30 to complete the general U-shape of seat frame 12 and terminates in a pair of ends 24 and 25 (end 25 seen in FIG. 2). End 24 is pivotally secured to support 13 by a pivot 20. In similar fashion, and as is better seen in FIG. 2, end 25 is pivotally secured to support 14 by a pivot 21. Pivots 20 and 21 may for example comprise elongated pivot pins extending through apertures formed in ends 24 and 25 and supports portions 13 and 14 (seen in FIG. 2).

A seat web 31 preferably formed of a light-weight high-strength fabric material and defines a pair of sleeve portions 32 and 33 received upon seat frame 12. Sleeves 32 and 33 may be formed by folding portions of seat web 31 about seat frame 12 and attaching the interior ends of seat web 31 to the spanning portion thereof using conventional attachment such as sewn stitching or the like as set forth in FIG. 10 and described below in conjunction therewith. Alternatively, sleeves 32 and 33 may be formed by wrapping a substantial quantity of seat web 31 upon seat frame 12 and securing sleeves 32 and 33 in place using conventional fasteners such as rivets or the like. In either event, the important aspect with respect to the present invention is the secure attachment of the end portions of seat web 31 to span seat frame 12. It has been found advantageous however from a manufacturing stand point to pre-form the sleeves (such as sleeves 32 and 33) prior to assembly and then simply slide them over the U-shaped frame.

Figure 2:
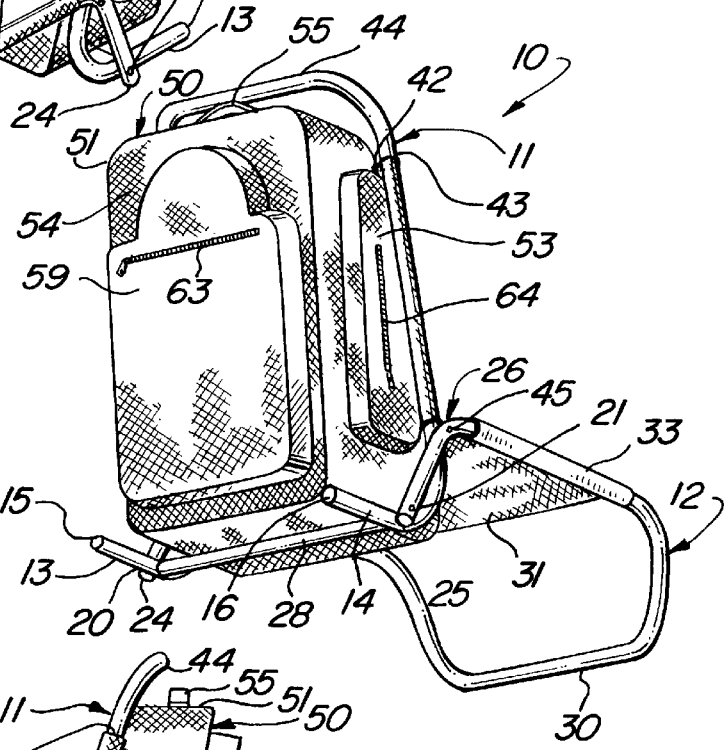
FIG. 2 sets forth a rear perspective view of the present invention combination backpack and folding chair in its open configuration.

Combination device 10 further includes a pair of releasable locks 22 and 26 (lock 26 shown in FIG. 2). With temporary reference to FIG. 4, lock 22 includes a movable lock pin 36 supported within seat frame 12 which cooperates with a lock recess 35 formed in seatback frame 11. Similarly, and as is better seen in FIG. 2, lock 26 includes a movable lock pin 45 supported within seatback 12. While not seen in FIG. 2, it will be understood that lock 26 is substantially identical to lock 22 and thus lock 26 includes a lock recess formed within seatback 11 which is substantially identical to lock recess 35 and which cooperates with lock pin 45.

Returning to FIG. 1, the cooperation of locks 22 and 26 operate to secure seat frame 12 to seatback frame 11 to maintain the open configuration shown in FIG. 1.

Combination device 10 further includes a backpack 50 fabricated of a light-weight material such as cloth fabric or the like. Backpack 50 further includes a pair of support webs 40 and 42 joined to a corresponding pair of sleeves 41 and 43. Sleeves 41 and 43 are joined to the side portions of seatback frame 11 and secure webs 40 and 42 to seatback frame 11. Backpack 50 further defines a main compartment 51 and an upper handle 55. Main compartment 51 is joined to webs 40 and 42 by conventional attachment such as sewn stitches or the like. Backpack 50 further includes a pair of shoulder straps 60 and 61 joined to the frontal surface of main compartment 51. A front cover 56 overlies shoulder straps 60 and 61 and supports an attachment portion 57. A cooperating attachment portion 58 is secured to the front surface of main compartment 51. Attachment portions 57 and 58 are preferably fabricated using cooperating attachments of the well known hook and loop fabric attachment mechanisms. However, it will be apparent to those skilled in the art that other attachment may be provided between front cover 56 and main compartment 51. In the open configuration of combination device 10 shown in FIG. 1, front cover 56 is positioned to overlie and enclose shoulder straps 60 and 61 to provide a comfortable seatback surface for the user.

Backpack 50 further includes a pair of side pockets 52 and 53 (sided pocket 53 seen in FIG. 2) which provides secondary storage of items separate from main compartment 51. Side pocket 52 includes a conventional zipper 27 to provide access thereto. It will be apparent that a variety of zipper and pocket arrangements may be used for backpack 50 without departing from the spirit and scope of the present invention.

In accordance with an important aspect of the present invention, combination device 10 when configured in the open configuration of FIG. 1 provides a comfortable, secure and stable seat for the user. The user is thus able to sit upon seat web 31 and lean back against front cover 56 in a comfortable seating position. In further accordance with the present invention, a substantial portion of the user's weight is transferred from seat web 31 and seat frame 12 to supports 13 and 14 (seen in FIG. 2) via the pivotal attachments at ends 24 and 25 (seen in FIG. 2). In this manner, the majority of the user's weight is well supported by the support portions to provide secure and stable seating. In further accordance with the present invention, the angle between support portions 13 and 14 (seen in FIG. 2) and the remainder of seatback frame 11 provides a solid and secure seatback support for the user's back. In further accordance with an additional advantage of the present invention, it will be noted that the entire support structure of combination device 10 is formed by a pair of generally U-shaped members (seat frame 12 and seatback frame 11) which are joined by a pair of simple pivot attachments. Thus, a complicated linkage mechanism is avoided and the additional weight and complexity thereof is not utilized. Finally, it will be noted that locks 22 and 26 provide further secure attachment between seat frame 12 and seatback frame 11 in the open configuration of combination device 10.

FIG. 2 sets forth a rear perspective view of combination device 10 in its open configuration. As described above, combination device 10 includes a seatback frame 11 having a crossmember 44 and a pair of supports 13 and 14. Supports 13 and 14 terminate in respective end portions 15 and 16. Further, seatback frame 11 includes a crossmember 28 joining support members 13 and 14. Combination device 10 further includes a seat frame 12 defining a generally U-shaped member having a crossmember 30 and a pair of ends 24 and 25. Ends 24 and 25 are pivotally secured to support members 13 and 14 respectively by a pair of pivots 20 and 21. A seat web 31 is secured to seat frame 12 by a pair of sleeves 32 and 33 (sleeve 32 shown in FIG. 1). A lock 26 including a lock pin 45 secures seat frame 12 and seatback frame 11 in the open configuration.

Combination device 10 further includes a backpack 50 having a main compartment 51 supporting a handle 55. Backpack 50 further includes a rear surface 54 supporting a rear pocket 59. Rear pocket 59 provides access to main compartment 51 and includes a conventional zipper 63. Backpack 50 further includes a side pocket 53 having access provided by a conventional zipper 64. As described above, backpack 50 is secured to seatback frame 11 by an attachment which includes a web 42 having a sleeve 43 providing attachment to seatback frame 11. As is better seen in FIG. 1, the opposite side of backpack 50 is secured to seatback frame 11 by a web 42 and a sleeve 43.

Figure 3:
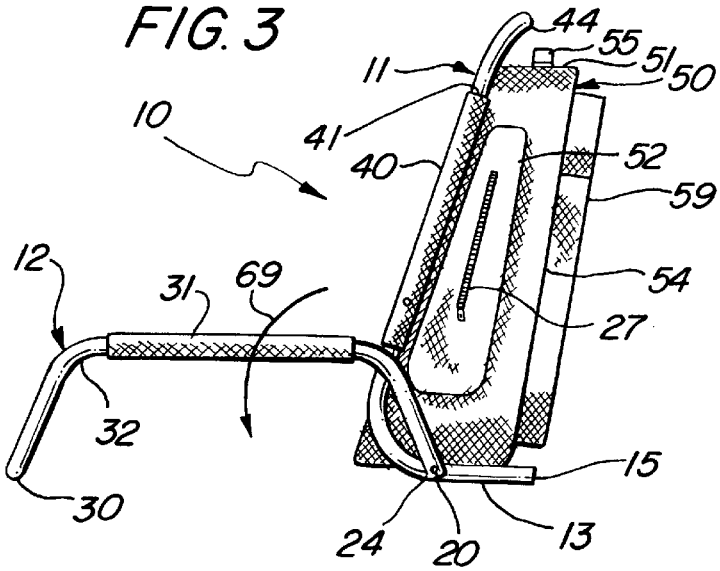
FIG. 3 sets forth a side elevation view of the present invention combination backpack and folding chair in its open configuration.

FIG. 3 sets forth a side elevation view of combination device 10 in the open configuration of FIGS. 1 and 2. As described above, when configured in its open position, combination device 10 provides a secure, well supported seat for the user. In accordance with an important aspect of the present invention, combination device 10 may be readily configured from the open position shown in FIG. 3 in which a convenient seat is provided to a closed position shown in FIG. 7 which facilitates the carrying of the present invention combination device in a similar fashion to a conventional backpack.

Figures 4, 5, 6:
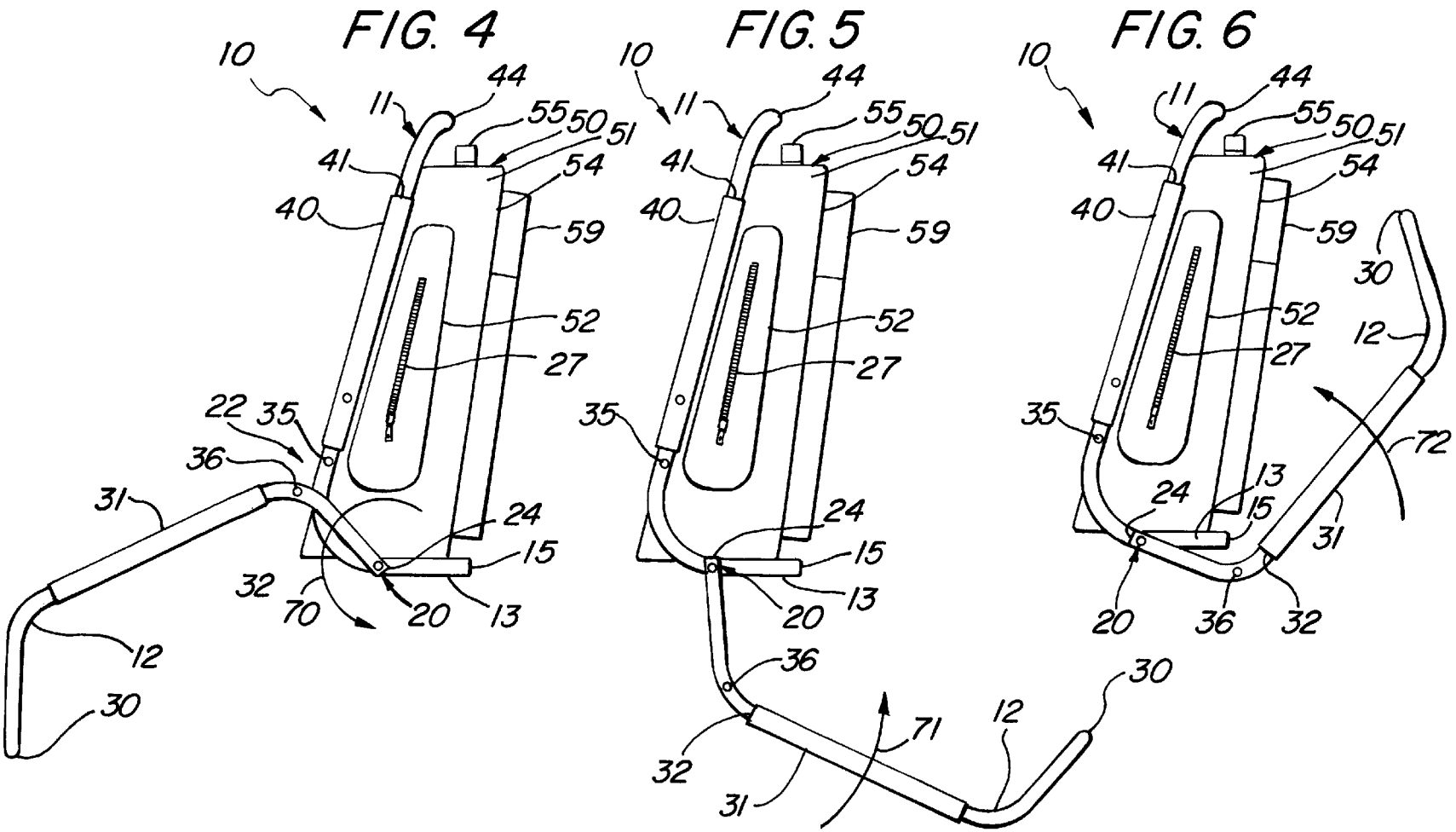
FIG. 4 sets forth a side elevation view of the present invention view of the present invention combination backpack and folding chair at the initiation of a folding operation.
FIG. 5 sets forth a side elevation view of the present invention combination backpack and folding chair at the approximate midpoint of folding action.
FIG. 6 sets forth a side elevation view of the present invention combination backpack and folding chair near the end of the folding action.
Figure 7:
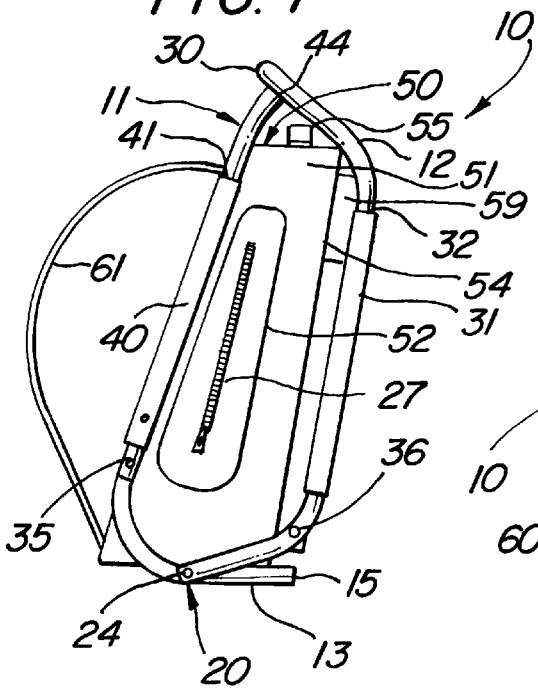
FIG. 7 sets forth a side elevation view of the present invention combination backpack and folding chair in its folded configuration.

By way of overview, FIGS. 4, 5 and 6 set forth sequential side elevation views which illustrate the transformation of combination device 10 from the open configuration shown in FIG. 3 to the closed configuration shown in FIG. 7. It will be noted by examination of FIGS. 3 through 7 that the transformation of combination device 10 from the open configuration shown in FIG. 3 to the closed configuration shown in FIG. 7 is carried forward by a simple pivotal movement of seat frame 12 with respect to seatback frame 11.

More specifically, combination device 10 includes a seatback frame 11 having a crossmember 44 and a pair of support members 13 and 14 defining respective ends 15 and 16 (support member 14 and end 16 shown in FIG. 2) combination device 10 further includes a seat frame 12 having a crossmember 30 and a pair of ends 24 and 25 (end 25 seen in FIG. 2). End 24 is pivotally secured to support member 13 by a pivot 20 while end 25 is pivotally secured to support member 14 by a pivot 21 (seen in FIG. 2). A seat web 31 is secured to seat frame 12 by a pair of sleeves 32 and 33 (sleeve 33 seen in FIG. 1).

Combination device 10 further includes a backpack 50 having a main compartment 51 supporting a handle 55. Backpack 50 further includes a side pocket 62 having a zipper 27 and a rear pocket 59. A sleeve 40 provides attachment for backpack 50 to seatback frame 11 in the manner described above.

In the open configuration shown in FIG. 3, a pair of lock mechanisms 22 and 26 (lock mechanism 26 seen in FIG. 2) releasably secure seatback frame 11 and seat frame 12 in the open configuration shown in FIG. 3. In this configuration, the user is able to be seated upon seat web 31 and rest against front cover 56 (seen in FIG. 1) supported by seatback frame 11. Combination device 10 is reconfigured from the open position shown in FIG. 3 to the closed position shown in FIG. 7 by initially releasing locks 22 and 26. In the preferred fabrication of the present invention, locks 22 and 26 are spring dependent to allow the separation of locks 22 and 26 by initially forcing seatback frame 11 and seat frame 12 apart at the locks on each side. Once locks 22 and 26 are released, the user simply grasps crossmember 44 and pivots seat frame 12 in the direction indicated by arrow 69. Once locks 22 and 26 have been released, seat frame 12 easily pivots with respect to seatback frame 11 in the direction of arrow 69 through the action of pivots 20 and 21 (pivot 21 seen in FIG. 2).

FIG. 4 sets forth a side elevation view of combination device 10 following the initial pivotal movement of seat frame 12 about pivots 20 and 21 as combination device 10 is being reconfigured into the closed configuration shown in FIG. 7.

More specifically, combination device 10 includes a seatback frame 11 having a crossmember 44 and a pair of support members 13 and 14 defining respective ends 15 and 16 (support member 14 and end 16 shown in FIG. 2) combination device 10 further includes a seat frame 12 having a crossmember 30 and a pair of ends 24 and 25 (end 25 seen in FIG. 2). End 24 is pivotally secured to support member 13 by a pivot 20 while end 25 is pivotally secured to support member 14 by a pivot 21 (seen in FIG. 2). A seat web 31 is secured to seat frame 12 by a pair of sleeves 32 and 33 (sleeve 33 seen in FIG. 1).

Combination device 10 further includes a backpack 50 having a main compartment 51 supporting a handle 55. Backpack 50 further includes a side pocket 52 having a zipper 27 and a rear pocket 59. A sleeve 40 provides attachment for backpack 50 to seatback frame 11 in the manner described above.

In the intermediate position shown in FIG. 4, the combined structure of seat frame 12 and seat web 31 is moving pivotally in the direction indicated by arrow 70 as seatback 12 pivots about pivots 20 and 21 (pivot 21 seen in FIG. 2). Once lock mechanisms 22 and 26 (seen in FIG. 2) have been released, the pivotal movement of seat frame 12 is easy and seat frame 12 is smoothly pivoted in the direction of arrow 70.

FIG. 5 sets forth a side elevation view of combination device 10 as seat frame 12 continues pivotal movement about pivots 20 and 21 (seen in FIG. 2) in the direction indicated by arrow 71.

More specifically, combination device 10 includes a seatback frame 11 having a crossmember 44 and a pair of support members 13 and 14 defining respective ends 15 and 16 (support member 14 and end 16 shown in FIG. 2) combination device 10 further includes a seat frame 12 having a crossmember 30 and a pair of ends 24 and 25 (end 25 seen in FIG. 2). End 24 is pivotally secured to support member 13 by a pivot 20 while end 25 is pivotally secured to support member 14 by a pivot 21 (seen in FIG. 2). A seat web 31 is secured to seat frame 12 by a pair of sleeves 32 and 33 (sleeve 33 seen in FIG. 1).

Combination device 10 further includes a backpack 50 having a main compartment 51 supporting a handle 55. Backpack 50 further includes a side pocket 52 having a zipper 27 and a rear pocket 59. A sleeve 40 provides attachment for backpack 50 to seatback frame 11 in the manner described above.

At the position shown in FIG. 5, the pivotal movement of seat frame 12 about pivots 20 and 21 (seen in FIG. 2) in the direction indicated by arrow 71 moves seat frame 12 rearwardly with respect to seatback frame 11 and positions seat frame 12 to begin pivoting upwardly upon the rear portion of seatback 50.

FIG. 6 sets forth a side elevation view of combination of combination device 10 as seat frame 12 is further rotated upon the rear side of backpack 50. At this point of the rotation of seat frame 12, seat web 31 is being moved to a position overlying the rear portion of backpack 50.

More specifically, combination device 10 includes a seatback frame 11 having a crossmember 44 and a pair of support members 13 and 14 defining respective ends 15 and 16 (support member 14 and end 16 shown in FIG. 2) combination device 10 further includes a seat frame 12 having a crossmember 30 and a pair of ends 24 and 25 (end 25 seen in FIG. 2). End 24 is pivotally secured to support member 13 by a pivot 20 while end 25 is pivotally secured to support member 14 by a pivot 21 (seen in FIG. 2). A seat web 31 is secured to seat frame 12 by a pair of sleeves 32 and 33 (sleeve 33 seen in FIG. 1).

Combination device 10 further includes a backpack 50 having a main compartment 51 supporting a handle 55. Backpack 50 further includes a side pocket 52 having a zipper 27 and a rear pocket 59. A sleeve 40 provides attachment for backpack 50 to seatback frame 11 in the manner described above.

As seat frame 12 continues to be pivoted about pivots 20 and 21 (pivot 21 seen in FIG. 2) in the direction indicated by arrow 72, web 31 is moved toward a position overlying rear pocket 59 and crossmember 30 is moved toward crossmember 44 of seatback frame 11.

FIG. 7 sets forth a side elevation view of combination device 10 in a fully closed configuration. More specifically, combination device 10 includes a seatback frame 11 having a crossmember 44 and a pair of support members 13 and 14 defining respective ends 15 and 16 (support member 14 and end 16 shown in FIG. 2) combination device 10 further includes a seat frame 12 having a crossmember 30 and a pair of ends 24 and 25 (end 25 seen in FIG. 2). End 24 is pivotally secured to support member 13 by a pivot 20 while end 25 is pivotally secured to support member 14 by a pivot 21 (seen in FIG. 2). A seat web 31 is secured to seat frame 12 by a pair of sleeves 32 and 33 (sleeve 33 seen in FIG. 1).

Combination device 10 further includes a backpack 50 having a main compartment 51 supporting a handle 55. Backpack 50 further includes a side pocket 52 having a zipper 27 and a rear pocket 59. A sleeve 40 provides attachment for backpack 50 to seatback frame 11 in the manner described above.

In accordance with an important aspect of the present invention, the closed configuration of seatback frame 11 and seat frame 12 is secured by the extension of crossmember 30 above crossmember 44. In accordance with the preferred fabrication of the present invention, the size and shape of seat frame 12 is selected to ensure that the underside of crossmember 30 is forced against the upper surface of crossmember 44 in a resilient spring fit which provides a locking action or interference between crossmember 44 and crossmember 30. The force fit of crossmember 30 across crossmember 44 is facilitated by a small amount of flexing of seat frame 12. Thus, a locking action or snap-lock action is provided which secures seat frame 12 in the closed configuration shown in FIG. 7. Once combination device 10 has been fully secured in the closed configuration of FIG. 7, the user may then utilize shoulder straps 60 and 61 (strap 60 shown in FIG. 8) in carrying combination device 10 in a similar fashion to the carrying of conventional backpacks.

Figure 8:
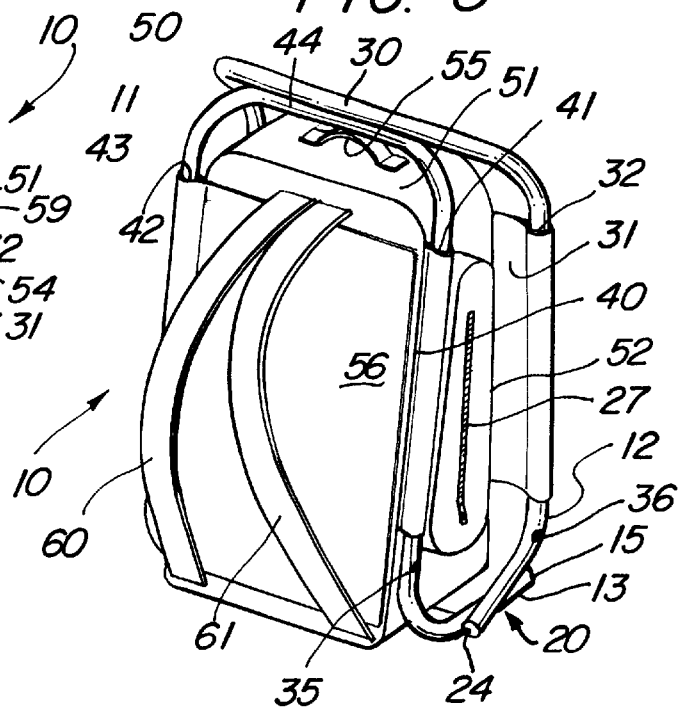
FIG. 8 sets forth a front perspective view of the present invention combination backpack and folding chair in its folded configuration.

FIG. 8 sets forth a rear perspective view of combination device 10 in the closed configuration. Combination device 10 includes a seatback frame 11 having a crossmember 44 and a pair of support members 13 and 14 (support member 14 seen in FIG. 9). Support 13 defines and end 15. Combination device 10 further includes a seat frame 12 having a crossmember 30 and a pair of ends 24 and 25 (end 25 seen in FIG. 9). A seat web 31 is joined to seat frame 12 by a pair of sleeves 32 and 33 (sleeve 33 shown in FIG. 9). Seat frame 12 is pivotally secured to support members 13 and 14 by a pair of pivotal attachments 20 and 21 (pivot 21 seen in FIG. 2).

Combination device 10 further includes a backpack 50 having a main compartment 51 supporting a handle 55 and a side pocket 52. Side pocket 52 further includes a zipper 27 for access. Backpack 50 further supports a pair of shoulder straps 60 and 61 secured to the frontal portion of main compartment 51. A front cover 56 is secured to the frontal portion of main compartment 51 and in accordance with the present invention is alternatively positioned beneath shoulder straps 60 and 61 as shown in FIG. 8 or overlying shoulder straps 60 and 61 as shown in FIG. 1. When front cover 56 is positioned beneath shoulder straps 60 and 61 as shown in FIG. 8, combination device 10 may be easily carried in a manner similar to conventional backpack apparatus. Alternatively, when front cover 56 is positioned overlying straps 60 and 61 as shown in the open configuration of FIG. 1, front cover 56 provides a more comfortable seat back for the user by covering shoulder straps 60 and 61. Backpack 50 is secured to seatback frame 11 by a pair of sleeves 41 and 43 together with a pair of attachment webs 40 and 42.

Figure 9:
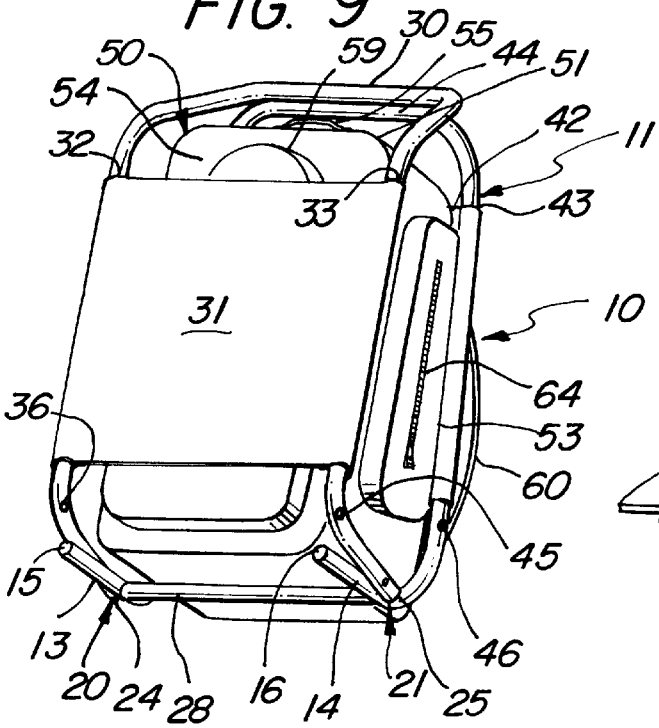
FIG. 9 sets forth a rear perspective view of the present invention combination backpack and folding chair in its folded configuration.

Thus, in accordance with the present invention, combination device 10 is secured in the closed configuration as shown in FIG. 8 by the interlock of crossmember 30 upon crossmember 44. In the preferred fabrication of the present invention, crossmember 30 is force-fitted or snap-fitted over the upper surface of crossmember 44. However, it will be apparent to those skilled in the art that the reverse configuration may be utilized without departing from the spirit and scope of the present invention. The important aspect with respect to the present invention is the ability of seat frame 12 and seatback frame 11 to snap-fit interlock in the closed configuration without resort to conventional locking apparatus. However, it will be apparent to those skilled in the art that other attachment mechanisms may be used to secure seatback frame 11 and seat frame 12 in the closed configuration of FIG. 8 without departing from the spirit and scope of the present invention in its broader context. FIG. 9 set forth a rear perspective view of combination device 10 in its closed configuration. Combination device 10 includes a seatback frame 11 having a crossmember 44 and a pair of support members 13 and 14 which in turn define ends 15 and 16. Combination device 10 further includes a seat frame 12 having a crossmember 30 and a pair of ends 24 and 25. Ends 24 and 25 are secured to support members 13 and 14 by a pair of pivots 20 and 21. Seat frame 12 further supports a pair of lock pins 36 and 45 which cooperate in the above described manner to form portions of locks 22 and 26 (seen in FIG. 1). Seat frame 12 further supports a seat web 31 secured thereto by a pair of sleeves 32 and 33.

Combination device 10 includes a backpack 50 supporting a handle 55 and having a main compartment 51. Backpack 50 further includes a rear surface 54 supporting a rear pocket 59 and a side pocket 53 having a zipper 64 for providing access thereto. A shoulder strap 60 is secured to the front portion of backpack 50.

Figure 10:
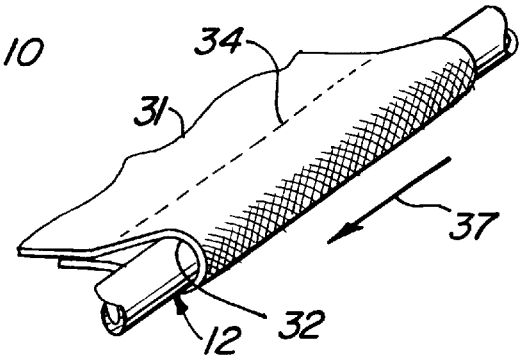
FIG. 10 sets forth a partial perspective view of an exemplary fabric attachment sleeve used in the present invention.

FIG. 10 sets forth a partial perspective view of sleeve 32 secured to a portion of seat frame 12. It should be noted that sleeve 32 and its attachment to seat frame 12 is illustrative of sleeve 33 and its attachment to seat frame 12 as well as sleeves 41 and 43 and their attachments to seatback frame 11. More specifically, sleeve 32 is formed by folding the end of seat web 31 to form a loop or sleeve and joining it to the underside of seat web 31 by a sewn seam 34. Once sleeves 32 and 33 (sleeve 33 seen in FIG. 1) are formed, seat web 31 is assembled to seat frame 12 by simply sliding ends 24 and 25 (seen in FIG. 2) through the sleeves in the manner illustrated by arrow 37.

What has been shown is a combination backpack and folding chair which utilizes a highly efficient light-weight frame formed of a seat frame and a seatback frame joined in pivotal attachment. A backpack is secured to the seatback frame and provides the dual function of a seatback surface and a backpack carrying apparatus. The seat frame supports a seat web which provides a seating surface for the user. The entire operative mechanism which facilitates the duel use of the combination device as a folding chair and backpack is provided by a single pair of movable frame components and a pair of pivotal attachments therebetween.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A combination backpack and folding chair comprising:

a backpack having a front surface and a rear surface;

a seat frame having a first crossmember and a first pair of ends;

a seatback frame having a second crossmember, a pair of sides, a pair of support members and a second pair of ends, said pair of support members forming acute angles with said sides;

a pair of pivots pivotally securing said first pair of ends to said pair of support members;

a seat web secured to said seat frame; and means for attaching said backpack to said seatback frame, said seat frame being pivotable with respect to said seatback frame between an open configuration forming a chair having a seating area formed adjacent said front surface and a closed configuration in which said seat web overlies said rear surface.

2. The combination backpack and folding chair set forth in claim 1 wherein said seat frame is sized with respect to said seatback frame to cause said first and second crossmembers interlock in said closed configuration.

3. The combination backpack and folding chair set forth in claim 2 wherein said seat frame and said seatback frame include a pair of locks releasably securing said seat frame to said seatback frame in said open position.

4. The combination backpack and folding chair set forth in claim 3 wherein said means for attaching includes;

a pair of sleeves secured to said seatback frame; and a pair of webs joining said pair of sleeves to said backpack.

5. The combination backpack and folding chair set forth in claim 4 wherein said backpack includes a pair of shoulder straps secured to said front surface of said backpack and wherein said backpack further includes a front cover supported upon said front surface, said front cover being positionable alternatively overlying or underlying said shoulder straps.

6. The combination backpack and folding chair set forth in claim 5 wherein said first crossmember interlocks with said second crossmember in said closed configuration passing above said second crossmember.

7. A combination backpack and folding chair comprising:

a backpack having a front surface and a rear surface;

a seat frame having a first crossmember and a first pair of ends;

a seatback frame having a second crossmember, a pair of sides, a pair of support members and a second pair of ends, said pair of support members forming acute angles with said sides;

a pair of pivots pivotally securing said first pair of ends to said pair of support members;

a seat web secured to said seat frame; and means for attaching said backpack to said seatback frame, said seat frame being pivotable with respect to said seatback frame in a first direction to form an open configuration in which a chair is formed such that a seating area is formed adjacent said front surface and being pivotable in a second direction opposite from said first direction to a closed configuration in which said seat web overlies said rear surface.

* * * * *